US006575533B1

(12) United States Patent
Kicos

(10) Patent No.: US 6,575,533 B1
(45) Date of Patent: Jun. 10, 2003

(54) TOWEL RETAINING DEVICE AND PILLOW

(76) Inventor: John J. Kicos, 18645 Vineyard Pointe La., Cornelius, NC (US) 28031

( * ) Notice: Subject to any disclaimer, the term of this patent is extended or adjusted under 35 U.S.C. 154(b) by 0 days.

(21) Appl. No.: 10/151,273

(22) Filed: May 20, 2002

(51) Int. Cl.[7] ..... A47C 1/10
(52) U.S. Cl. ..... 297/397; 297/188.06
(58) Field of Search ..... 297/188.06, 188.07, 297/188.2, 219.1, 220, 224, 391, 394, 397, 398, 230.1, 230.13, 230.14, 393, 4; 224/901.4, 250

(56) References Cited

U.S. PATENT DOCUMENTS

| | | | | |
|---|---|---|---|---|
| 1,841,410 | A | | 1/1932 | Karr |
| 2,452,103 | A | * | 10/1948 | Conradt |
| 2,464,435 | A | * | 3/1949 | Conradt |
| D247,312 | S | | 2/1978 | Zeiss |
| 4,097,086 | A | | 6/1978 | Hudson |
| D250,835 | S | | 1/1979 | Grube |
| 4,154,478 | A | * | 5/1979 | Cohune |
| D253,790 | S | | 12/1979 | Grube |
| D280,170 | S | | 8/1985 | Short |
| 4,536,028 | A | | 8/1985 | Jones et al. |
| D282,407 | S | | 2/1986 | Braun et al. |
| 4,815,154 | A | | 3/1989 | Grimes |
| 4,844,540 | A | | 7/1989 | Pegram |
| 4,877,288 | A | | 10/1989 | Lee |
| 4,884,305 | A | | 12/1989 | Blackmon |
| D311,109 | S | | 10/1990 | Greschwender |
| D312,019 | S | | 11/1990 | Woods et al. |
| 4,997,234 | A | * | 3/1991 | Royle et al. |
| 5,015,036 | A | * | 5/1991 | Fergie |
| 5,240,158 | A | * | 8/1993 | Walsh |
| 5,327,595 | A | | 7/1994 | Allen |
| 5,345,633 | A | * | 9/1994 | Harnish |
| 5,374,238 | A | | 12/1994 | Xiao |
| 5,503,456 | A | | 4/1996 | Rossini |
| 5,544,378 | A | * | 8/1996 | Chow |
| 5,567,055 | A | * | 10/1996 | Smith |
| 5,611,123 | A | | 3/1997 | Prizzi |
| 5,829,832 | A | | 11/1998 | Molee et al. |
| 5,964,504 | A | | 10/1999 | Hogan et al. |
| 6,126,237 | A | | 10/2000 | Ritterhouse |
| 6,149,234 | A | * | 11/2000 | Daniels |
| 6,158,642 | A | * | 12/2000 | Herbage |
| D449,953 | S | | 11/2001 | Mixon |

FOREIGN PATENT DOCUMENTS

| | | | |
|---|---|---|---|
| GB | 2194883 | * | 3/1988 |

* cited by examiner

*Primary Examiner*—Milton Nelson, Jr.
(74) *Attorney, Agent, or Firm*—Kennedy Covington Lobdell & Hickman, LLP

(57) ABSTRACT

A device for retaining a towel on a beach chair includes a pillow member with a cover and a padding element, and an elastic strap member connected to the pillow at a number of connection locations on the back of the pillow. The elastic strap member is an essentially continuous loop of elastic material and is stretchable to encircle the back of the chair, such that when the device is in place, the strap is taut and acts to retain the towel on the chair. The device further includes additional connections between the strap and the pillow member to form flat item hiding locations for maintaining valuable items such as credit cards, ID cards, folded paper money, and the like, hidden by the pillow from ready public view.

8 Claims, 4 Drawing Sheets

TOWEL RETAINING DEVICE AND PILLOW

FIELD OF THE INVENTION

The present invention relates to a device for retaining a towel on a chair, such as a beach chair, such that the towel is maintained in place on a chair even in windy conditions.

BACKGROUND OF THE INVENTION

An age-old problem in relaxing at the beach or at poolside is in maintaining a sufficient level of comfort to allow such an outing to be relaxing. Various types of chairs appropriate for the beach or the pool, such as chaise lounges, upright chairs, and so on, are formed from a metal, wood, or plastic frame and include a number of rubber or plastic straps, or cloth or fiber mesh, which act to support the weight of the individual in a relaxing position for reading, listening to music, or sunbathing. Because these chairs are typically left outside, exposed to the elements, the materials used to make the chairs are the most resilient rather than the most comfortable.

However, if such chairs are left in the sun, they may become uncomfortably hot. Alternatively, a person may be wet or covered in sand from the beach and may wish to protect the chair against these elements. Consequently, a large beach towel is often placed upon the chair, which provides some measure of comfort for the wet or sandy individual and protection for the chair.

For meteorological reasons well known in the art, beaches are subject to wind of significant strength, such that a towel not held in place by a body may be easily blown from the chair and lost or soiled. Moreover, natural movement of the individual while sitting or lying on the towel, as well as gravity, may cause the towel to become dislodged and the chair to be made uncomfortable.

What is needed, therefore, is a device which serves to retain the towel in place on the chair, even if high winds are present or the individual using the chair moves frequently.

OBJECT AND SUMMARY OF THE INVENTION

It is accordingly an object of the present invention to provide for a means by which a towel may be retained on a beach chair or a similar chair.

It is a further object of the present invention to provide for additional comfort in using the chair by providing a head rest for the individual using the chair.

It is another object of the present invention to provide for a secure and hidden location for ID cards, credit cards, access devices such as key cards of the type typically used by hotels for room access, folded paper money, keys, and the like, so that a person may secure those items while at the beach or the pool without keeping them on his person, but keeping them out of view and out of a beach bag, purse, or other container where a thief would be most likely to look.

In accordance with these and other objects of the present invention, the present invention provides for a device for retaining a towel on a chair. The device generally includes a pillow member and a strap member connected to the pillow member. The pillow member includes a back portion, which serves as a location for connecting the strap thereto, and a front portion, which provides for a headrest for the individual sitting in the chair. The strap member is preferably formed of an elastic material and is an essentially continuous loop that is attached to the pillow at a first connection location at an edge of the back of the pillow member. The strap member is stretchable to encircle the chair and preferably includes just enough material so that the elastic return action of the strap holds the strap taut against the chair, thereby likewise exerting a retaining force on a towel placed between the chair and the strap.

The present invention also makes use of the connection between the strap and the pillow to form a retaining location or a "flat item hiding" location between the strap member and the back of the pillow that is suitable for holding an identification card, a credit card, a key card (such as those of the type typically used for electronic access to hotel rooms), one or more folded bills of paper money, or the like. Because the strap member is connected across the back of the pillow member, when the invention is in place on a chair with a towel, any items retained in the retaining location are hidden from ready public view.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
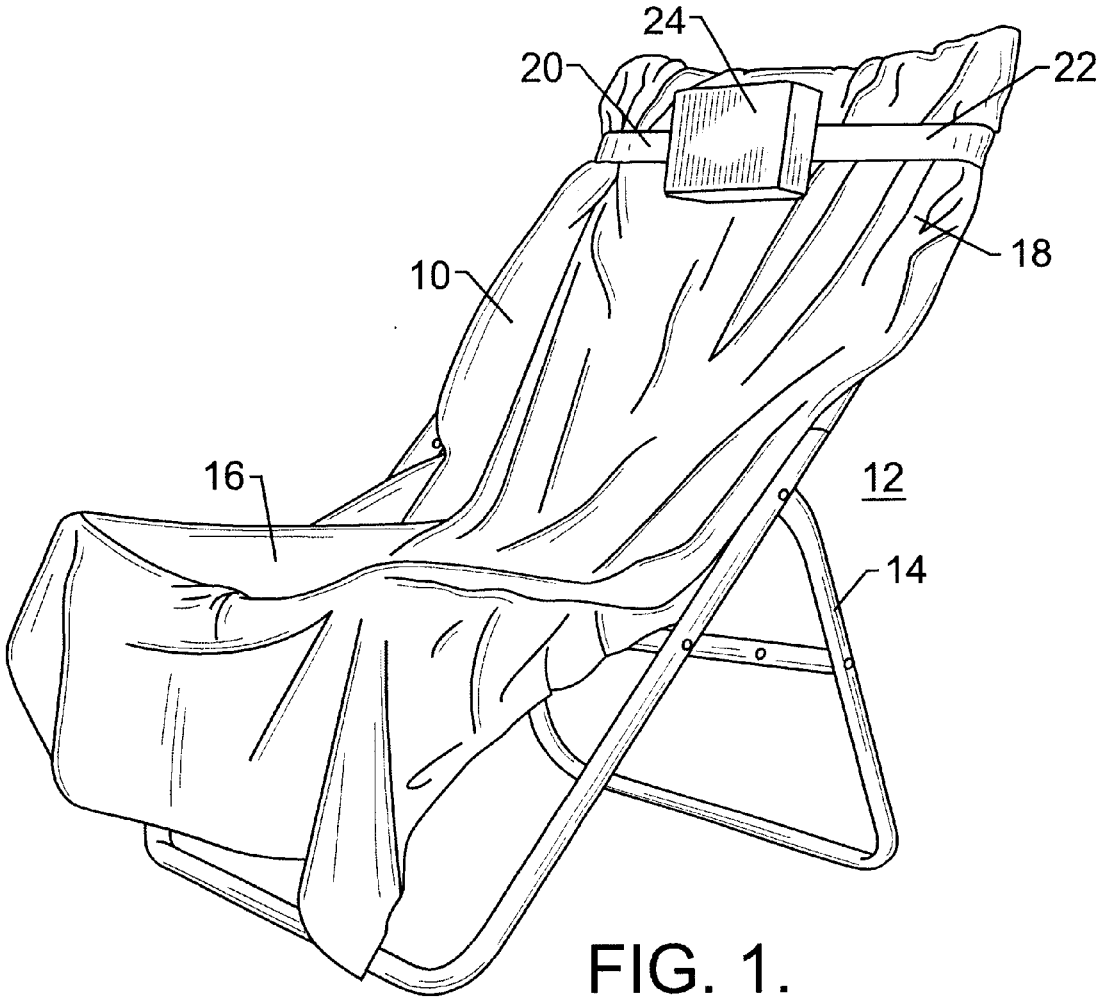
FIG. 1 is a general perspective view of a preferred embodiment of the present invention in place on a beach-type chair.

Referring now to FIG. 1, a preferred embodiment of the present invention is depicted in a general perspective view. A beach towel 10 is draped across a conventional beach chair 12, which chair generally includes a frame 14 made of metal, plastic, or wood, and a sitting surface 16 formed by attaching rubber or plastic straps or cloth mesh (not shown) across the frame 14. The towel 10 may be formed of any suitable material and is typically of sufficient size to cover the whole of the sitting surface 16 of the chair 12. A device 20 according to the present invention has been placed around the back 18 of the chair 12 to hold the towel 10 in place, and by the elastic return force exerted by the strap 22, the towel 10 is held in place on the chair 12 against a displacing force such as wind or movement of an individual into, out of, or within the chair.

As can be seen in FIG. 1, a pillow member 24 is located so as to provide a resting place for the head of an individual sitting in the chair 12, thereby increasing the comfort of the chair 12. A device 20 according to the present invention could, alternatively, be placed lower on the chair frame 14 to provide additional padding for the back of the individual, if desired.

As can also be seen most clearly in FIG. 1, when a device 20 according to the present invention is in place on a chair 12 with a towel 10 draped thereon, the back of the pillow member 24 is hidden from public view and, as will be described in greater detail later, forms a hiding location for valuables such as identification cards, credit cards, paper money, and the like.

Figure 2:
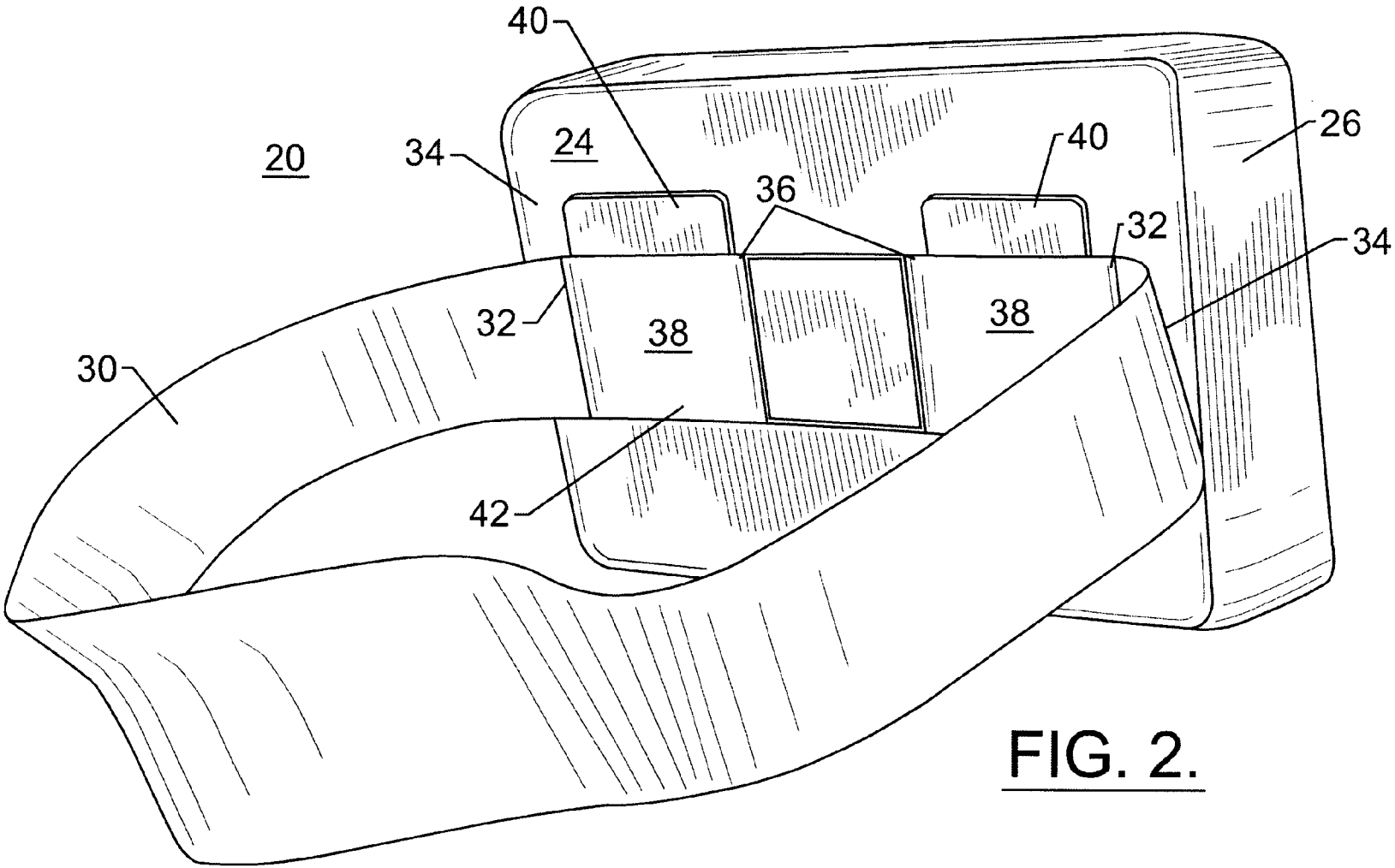
FIG. 2 is a perspective view of the rear of the preferred embodiment.

Referring now to FIG. 2, a preferred embodiment of the present invention is presented in greater detail in a view from the rear thereof. A pillow member 24 is provided, which pillow member 24 includes a cover 26 surrounding a padding core 56 (see FIG. 4). The core may be formed of a suitably soft and, preferably, washable material, such as foam rubber, polyester, polyethylene foam, or the like, so as to provide both comfort and support to the head of the individual using the device 20. Because the device 20 may come into contact with water or sand, the core 56 may be treated with a fungicidal agent or the like, to inhibit the growth of mildew or bacteria.

A strap member 30 includes a continuous loop of elastic material, which loop is formed by connecting the two ends of a length of elastic material. Although a non-continuous loop, attached by means of a connector, is possible, a continuous loop is preferable so as not to entice a malicious individual to disconnect the connector when the strap member 30 is in a stretched condition, or not to permit the connector to become disconnected accidentally, in either of which cases could the user or others be injured. The strap member is connected to the pillow member at at least one and preferably at two connection locations 32, which connection locations 32 are located at or reasonably near the edges 34 of the pillow member 24. By connecting the strap member 30 at an edge 34 of the pillow member 24, it is possible to utilize the back 28 of the pillow 24 as a hiding location for valuables. Moreover, connecting the strap member at the edges 34, particularly if at least two connections are utilized, provides additional stability of the pillow member 24 on the strap 30 and aids in retaining the pillow member 24 in the desired location after placement of the strap 30 on the chair 12 (see FIG. 1).

As depicted in FIG. 2, additional connections 36 between the strap 30 and the pillow member 24 may be utilized to form retaining locations 38 such as "flat item hiding" locations. These retaining locations 38 are preferably just narrower than the width of a standard credit card or identification card (approximately. two inches), so that a valuable flat item 40 such as a credit card, an ID card, a hotel electronic access card, or even one or more folded bills of paper money may be inserted into the retaining location 38 and held in place by the section of strap 30 between the two connections 32, 36 that form the retaining location 38. When the device 20 is in place on a chair 12 with a towel 10 (see FIG. 1), any items 40 inserted in the retaining location 38 are hidden from ready public view. This use of the present invention allows an individual to leave the chair 12 temporarily, such as to swim in the ocean or pool, without having to carry such items 40 into the water (risking damage to them) or leaving them in an obvious hiding location such as a purse or beach bag. If it is desired to place items 40 smaller than those contemplated above into the retaining locations 38, such as a conventional metal key, coins, or the like, it is a simple matter to make a partial or full attachment of the strap 30 to the pillow member 24 across the otherwise open bottom edge 42 of the retaining location 38.

The connections 32, 36 between the strap 30 and the pillow member 24 are preferably made substantially permanent, such as by sewing the strap 30 to the pillow cover 26, rather than by snaps, a hook-and-loop fastener, or other easily removable means. By anchoring the pillow member 24 firmly on the strap 30, flat items 40 placed in the retaining locations 38 are more easily held in place by tension. Moreover, it is desirable to maintain the pillow member 24 in a fixed location once a device 20 according to the present invention has been placed on the chair 12, and an impermanent connection would permit the pillow member 24 to be inadvertently removed from the strap 30, which in turn would allow any articles 40 stowed in the retaining locations 38 to fall out. In a preferred embodiment, the strap 30 is attached by sewing the strap 30 to the pillow member 24 across the entire width of the strap 30, perpendicular to the length of the loop.

Figure 3:
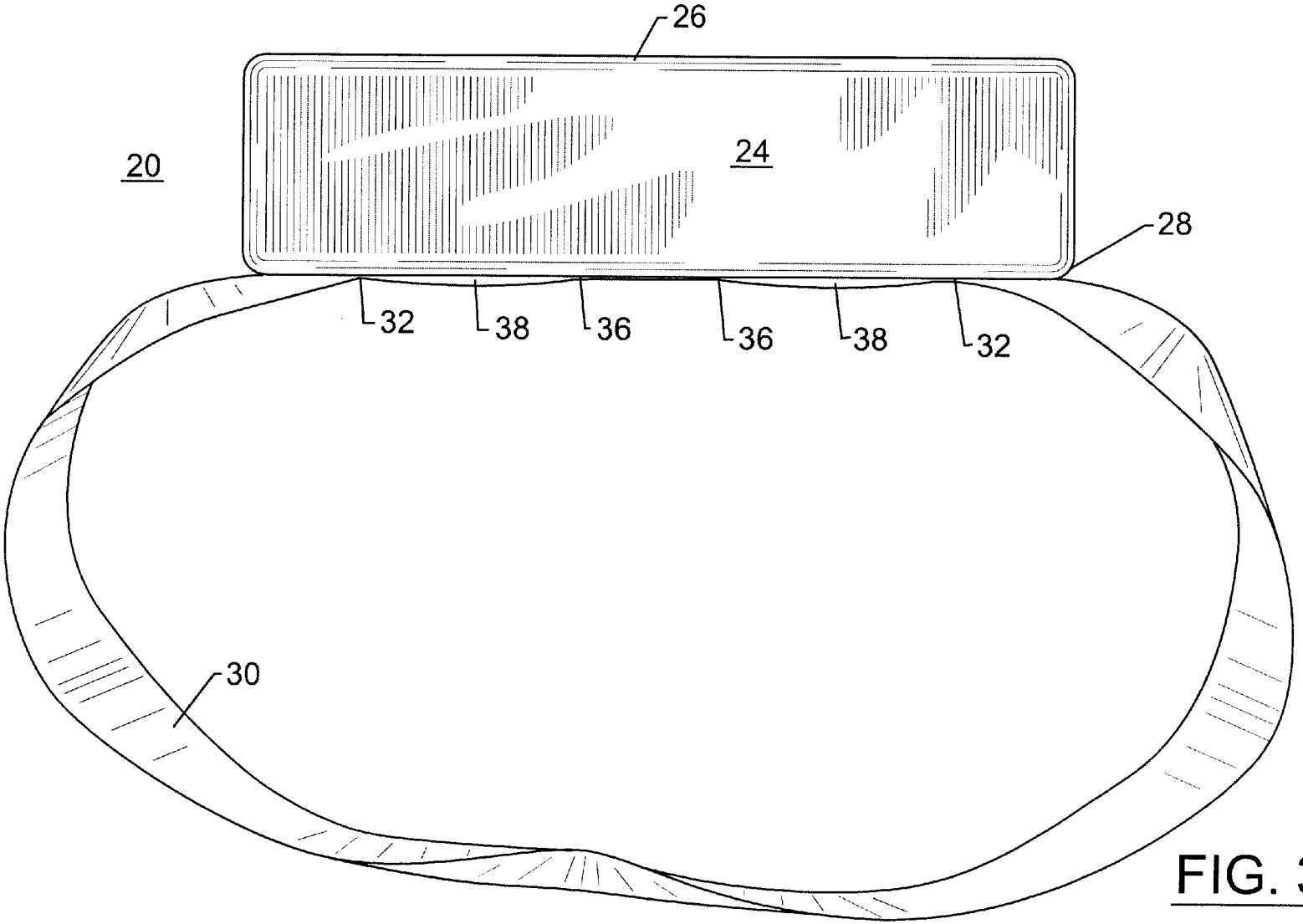
FIG. 3 is a top view of the preferred embodiment.

Referring now to FIG. 3, a top view of a device 20 according to the present invention reveals that the strap 30 is connected to the pillow member 24 solely along the back portion 28 thereof. By connecting a continuous loop of elastic material (the strap 30) only to the back portion 28 of the pillow member 24, the strain associated with the stretching of the strap 30 to place it around the back of a chair 12 (see FIG. 1) is not exerted on the pillow member 24 or the cover 26 thereof. In the manner, the life of the pillow member 24 is increased because there is virtually no tension placed on the pillow cover 26. Moreover, because the strap 30 extends across the back 28 of the pillow member 24, the present invention permits the placement of retaining locations 38 for flat items 40 (see FIG. 2) on the back side 28 of the pillow member 24, merely by making additional connections 32, 36 between the strap 28 and. the pillow member 24.

Figure 4:
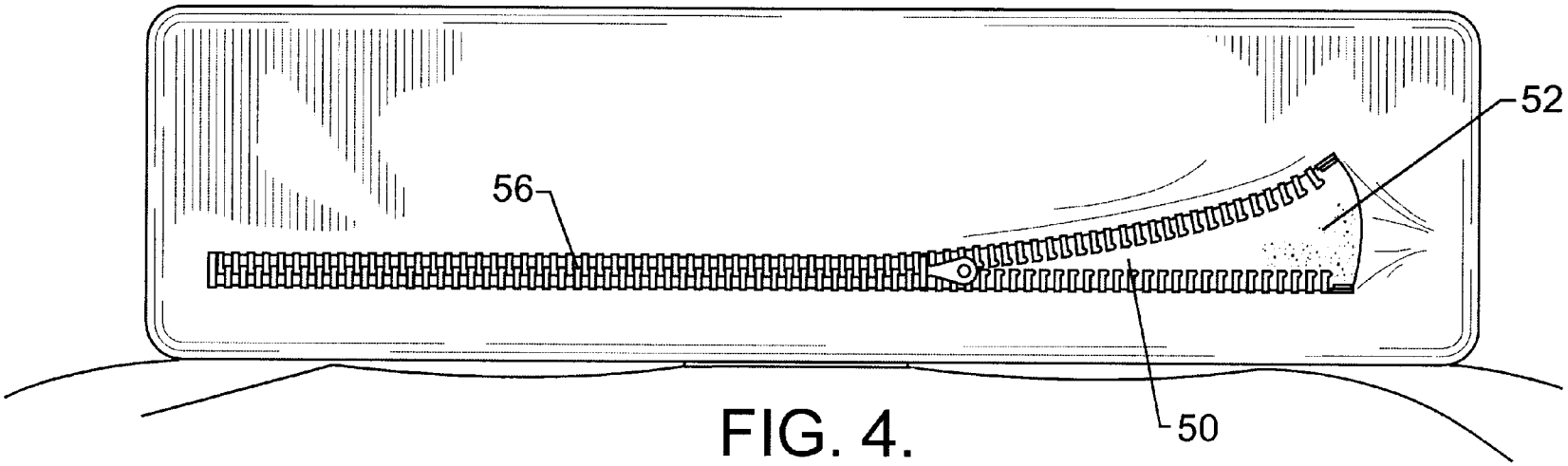
FIG. 4 is a bottom view of another preferred embodiment of the present invention.

In the preferred embodiment, the whole of the device 20 is water-washable, for easy cleanup should the device 20 become soiled. The strap 30 includes an elasticized material, preferably a mixture of cotton, polyester, or nylon fibers and latex or plastic elastic fibers, and in any case is water-washable. The pillow member 24 is preferably formed as an orthogonal parallelipiped, although virtually any shape of the pillow member 24 is possible and, given a particular application, another shape might be desirable over a parallelipiped. The cover 26 of the pillow member 24 is preferably formed of cotton fabric or a cotton-polyester blend fabric for comfort, although any suitable fabric may be used. The core padding element 52 (see FIG. 4), as noted above, may be formed of foam rubber, polyethylene foam, or polyester fiber in bulk, or the like, and in a preferred embodiment is not removable (the cover 26 being sewn shut). However, it is within the scope of the invention to provide for an opening 50 (see FIG. 4) in the cover 26 to permit removal and replacement of the core padding element 52. Referring now to FIG. 4, another embodiment of the present invention is depicted in a bottom view. This embodiment of the present invention is provided with an opening 50 to the cover 26, which opening 50 is closeable by any suitable means for opening and closing the opening, such as a zipper 56 or a hook-and-loop closure, a snap, a button, or the like (not shown).

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A device for retaining a towel on a chair, comprising a pillow member comprising a back; and a strap member fixedly connected to the pillow member at a first connection location near an edge of the back of the pillow member and on the back at a second connection location spaced from the first connection location to form a retaining location between the strap member and the back of the pillow for a flat item; wherein the strap member comprises a continuous loop of elastic material stretchable to encircle the chair and the towel and to exert a retaining force on the towel against the chair.

2. The device of claim 1, wherein the pillow member is substantially orthogonally parallelipipedal.

3. The device of claim 1, wherein the pillow member comprises a cover and a padding element.

4. The device of claim 3, wherein the cover and the padding element are washable.

5. The device of claim 3, wherein the cover further comprises an opening through which the padding element may be removed and replaced.

6. The device of claim 5, further comprising means for opening and closing the cover.

7. A device for retaining a towel on a chair, comprising:

a pillow member comprising a cover and a padding element, the cover including a back;

an elastic strap member fixedly connected to the pillow at a plurality of connection locations, wherein the elastic strap member is of sufficient length to be stretchable to encircle a chair and a towel placed thereon and retractable to retain the towel in place on the chair; and a flat item hiding location formed by fixedly attaching the elastic strap member to the back of the cover at a further location spaced from one of the connection locations, such that the elastic strap member acts to retain a flat item on the back of the pillow member between the one of the connection locations and the further location and the flat item is hidden from ready view when the device is placed on the chair.

8. The device of claim 7, wherein the flat item comprises one or more access devices, identification cards, credit cards, keys, or folded bills.

* * * * *